US006567998B2

(12) United States Patent
D'Ugo

(10) Patent No.: US 6,567,998 B2
(45) Date of Patent: May 27, 2003

(54) SHOWER APPARATUS

(76) Inventor: Carl D'Ugo, 102 Lincoln St., Staten Island, NY (US) 10305

( * ) Notice: Subject to any disclaimer, the term of this patent is extended or adjusted under 35 U.S.C. 154(b) by 0 days.

(21) Appl. No.: 09/990,469

(22) Filed: Nov. 21, 2001

(65) Prior Publication Data

US 2002/0083518 A1 Jul. 4, 2002

Related U.S. Application Data

(60) Provisional application No. 60/252,702, filed on Nov. 22, 2000.

(51) Int. Cl.[7] ..... A47K 4/00
(52) U.S. Cl. ..... 4/569; 4/601
(58) Field of Search ..... 4/567–570, 601, 4/605

(56) References Cited

U.S. PATENT DOCUMENTS

| | | | | | |
|---|---|---|---|---|---|
| 430,257 | A | * | 6/1890 | Taylor | 4/567 |
| 615,486 | A | * | 12/1898 | Jendis | |
| 924,602 | A | * | 6/1909 | Dimond | 4/567 |
| 944,611 | A | * | 12/1909 | Holmes | 4/567 |
| 1,130,520 | A | * | 3/1915 | Kenney | 4/567 |
| 1,146,353 | A | * | 7/1915 | Shapley | 4/567 |
| 1,728,129 | A | * | 9/1929 | Madison | 4/567 |
| 3,724,760 | A | * | 4/1973 | Smith | |
| 3,858,252 | A | * | 1/1975 | Ejchorszt | 4/569 |
| 4,809,369 | A | * | 3/1989 | Bowden | 4/601 |
| 4,927,083 | A | * | 5/1990 | Daunt | 4/569 |
| 5,742,961 | A | * | 4/1998 | Casperson et al. | 4/601 |
| 5,909,969 | A | * | 6/1999 | Davison | 4/567 |

FOREIGN PATENT DOCUMENTS

| | | | | |
|---|---|---|---|---|
| EP | 401 118 A | * | 12/1990 | 4/601 |

* cited by examiner

*Primary Examiner*—Charles R. Eloshway
(74) *Attorney, Agent, or Firm*—Salvatore J. Maiorino

(57) ABSTRACT

An improved shower apparatus is provided where a two-way selector valve is placed between a pre-existing shower head and a pipe to selectively allow water to flow between the shower head and a flexible rubber hose connected to a substantially cylindrical member. The member has a plurality of holes disposed along its length to create a horizontal triangular water spray. The bottom end of the member is removably attached to a wall of the shower and the rubber hose is looped around a retainer housing to provide vertical height adjustment.

8 Claims, 3 Drawing Sheets

SHOWER APPARATUS

CROSS-REFERENCE TO RELATED APPLICATION

This application claims priority from U.S. Prov. patent application No. 60/252,702, entitled "Improved Hydrotherapy and Shower Apparatus," filed Nov. 22, 2000.

BACKGROUND

Showers typically include a single shower head at an elevated position, pointing downward in a tiled enclosure. Some improvements exist in the prior art in the forms of elongated shower pipes and multiple shower heads.

Taylor, U.S. Pat. Nos. 432,712, and 439,793 purport to disclose a shower system providing a number of water sources directed to different parts of the body and under separate control.

Clifford, et al., U.S. Pat. No. 475,754 purports to disclose a system similar to Taylor, but has two wing sections which can fold out of the way when not in use.

Newton, U.S. Pat. No. 819,582 purports to diclose another shower system similar to those of Taylor and Clifford et al., but which is removably mounted on the rim of a bathtub.

Dimond, U.S. Pat. No. 924,602, and Holmes, U.S. Pat No. 944,611 purport to disclose shower systems with three, vertical sources of spray adjacent a flat tub wall above the tub's nozzle.

Ejchorszt, U.S. Pat. No. 3,858,252, purports to disclose a shower attachment with a multi-position valve to direct water to various portions or sections of the attachment.

Ejchorszt, U.S. Pat. No. 3,984,879, purports to disclose a "built in" multiple spray shower.

Bowden, U.S. Pat. No. 4,809,369, purports to disclose a portable shower with a plurality of linear tubular sections which can be connected together to form a single elongated spray head of desired length.

Daunt, U.S. Pat. No. 4,927,083, purports to disclose a variation of the spacing and location of spray apertures to provide different volumes of water from a spray head to different locations.

Jendis, U.S. Pat. No. 615,486, purports to disclose a vertical spray pipe that can have its jets cut off whole, or in part.

Smith, U.S. Pat. No. 3,724, 760 purports to disclose a vertical pipe with spray apertures surrounded by a moveable, water-tight sleeve having pre-determined cut out areas to provide for turning the spray on and off.

Davison, U.S. Pat. No. 5,909,969 purports to disclose a full body shower system with three generally horizontal water dispensing portions.

SUMMARY OF THE INVENTION

An improved shower apparatus is provided comprising a substantially cylindrical member with an upper and lower end. The upper end has means for removably attaching to a water source and the lower end has means for removably attaching to a stationary structure. A plurality of holes are disposed along the length of the member in a predetermined pattern constructed and arranged to create a horizontal, triangular water spray so that the water spray strikes an object at a substantially right angle.

In a second embodiment of the present invention, a plurality of cylindrical members are positioned along the perimeter of a shower with their resultant water spray converging in the center of the shower.

DETAILED DESCRIPTION

Figure 1:
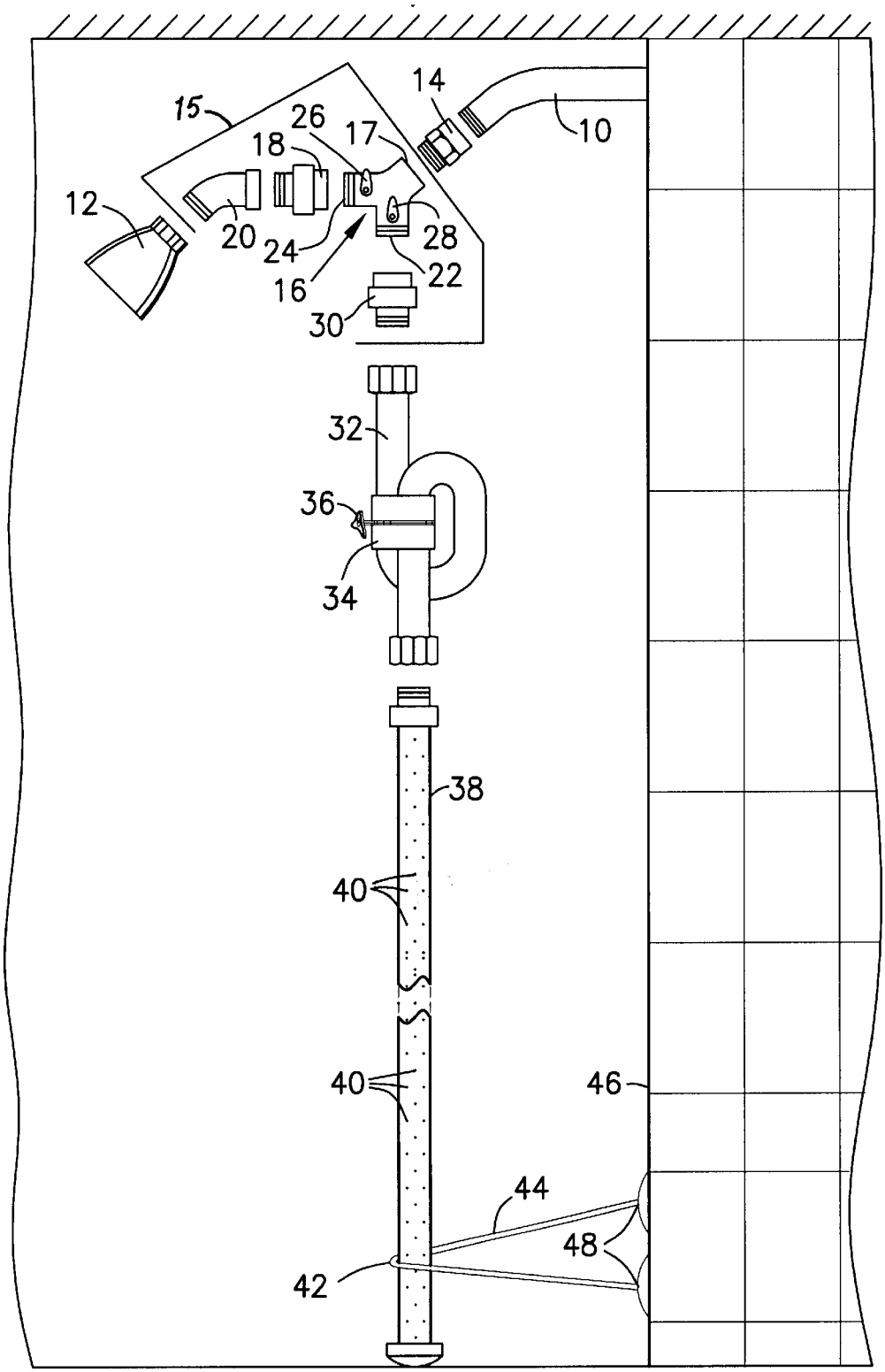
FIG. 1 is a side view of an improved hydrotherapy and shower apparatus in accordance with a preferred embodiment of the present invention.

FIG. 1 illustrates an improved hydrotherapy apparatus in accordance with an embodiment of the present invention. The apparatus is installed in a preexisting shower assembly onto a pipe 10 that supplies water to a pre-existing shower head 12. To install the inventive apparatus, the shower head 12 is disconnected from the pipe 10. An adapter 14 is coupled to a two-way selector valve 16 having one input 17 and two outputs 22, 24 to control the direction and flow of water. One output 24 is connected to an adapter 18 that attaches to a shower head coupler 20 which, in turn, is coupled to the shower head 12. Alternatively, the two-way selector valve, the adapter 18, shower head coupler 20, and the adapter 30 can all be combined into one piece outlined by line 15.

The other output 22 of the valve 16 is connected to an adapter 30. The adapter 30 is coupled to a flexible loop hose 32 run through a height adjustment retainer housing 34 with a tension knob 36. The hose 32 is connected to a substantially cylindrical member 38 with a plurality of holes 40 disposed along its length. The bottom end of the member 38 is connected to a bracket 44 by a clip 42. The bracket 11 is secured to a wall 46, preferably with suction cups 48 to maintain simplicity in the installation process.

The retainer housing 34 absorbs the reactive force caused by water running through the member 38. Turning the knob 36 on the housing 34 moves the member in a substantially vertical direction, up or down, to varying heights according to the preference of a user.

The valve 16 allows a choice of water spray configurations. To use the shower head 12, the controller 26 on the valve is opened to allow water to flow to the shower head 12 via the adapter 18 and coupler 20. Opening the controller 28 allows water to flow to the cylindrical member 38 and out the holes 40 to create an angular water spray in a delta pattern. The controllers 26 and 28 can be opened or closed in any combination, depending on personal preference.

Figure 2:
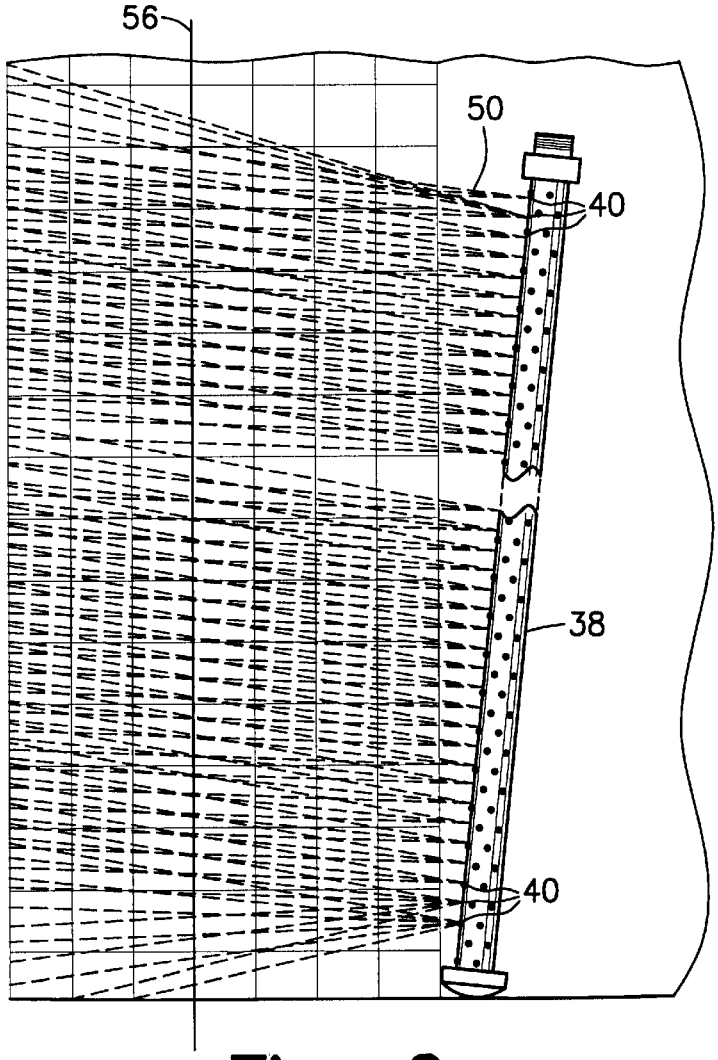
FIG. 2 is a side view of the water spray produced by the apparatus of FIG. 1.

The holes 40 on the member 38 are constructed in a specific pattern to create a horizontal, triangular water spray. FIG. 2 shows a side view of the water spray 50 from the member 38 through the holes 40. A cross section of the spray 50 taken along line 56 reveals a rectangular plane of water. In a preferred embodiment of the present invention, the water spray has a substantially uniform density throughout its cross section along line 56.

The construction and arrangement of the above embodiment is such that the inventive apparatus may be easily installed and removed from the pre-existing pipe 10 and shower head 12 by simply coupling the individual pieces at their threaded sections.

Figure 3:
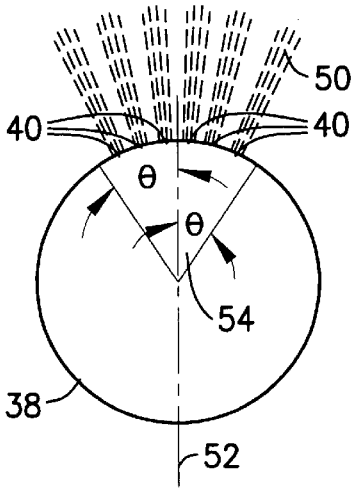
FIG. 3 is a top view of the water spray in FIG. 2.

Water is projected outwardly from the member 38 at a predetermined angle from the centerline of the member as shown in FIG. 3, which is a top view of the water spray 50 and the member 38 in FIG. 2. Holes 40 are positioned on one side of the member 40 to produce a water spray 50 at a predetermined angle 54 from the centerline 52 of the member 38. The angle 54 can be anywhere from 10 to 40 degrees, but preferably is around 20. The resultant arc is between 20 and 80 degrees, but preferably around 40. The holes 40 can be of a fixed diameter throughout, or a varying diameter as a function of position on the member 38. The holes 40 are preferably in the range of 0.02 to 0.03 inches in diameter.

Figure 4:
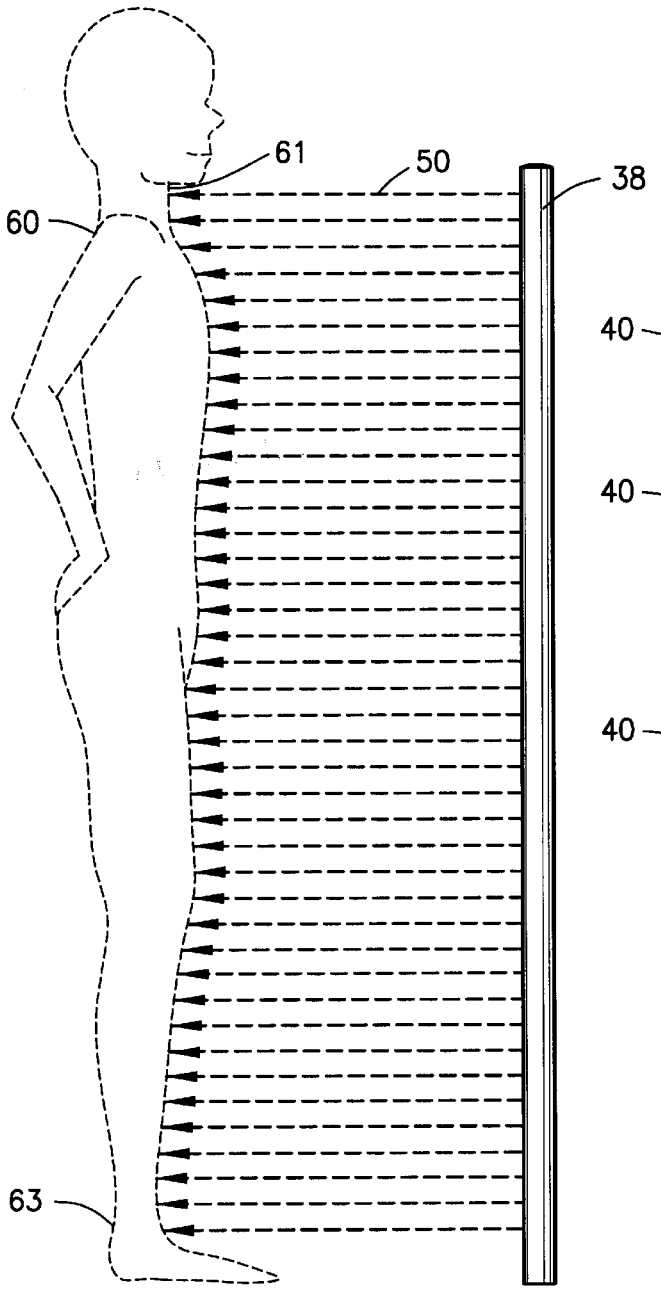
FIG. 4 depicts an exemplary pattern of holes on a cylindrical member according to the present invention.

Referring now to FIG. 4, there is shown a human 60 being struck by the water spray 50 created by the member 38. The streams of water in the spray 50 strike the person 60 at a substantially right angle to the person's 60 body surface, thereby maximizing the amount of pressure the water 50 can exert on the body because of the direct angle with which the water strikes. Preferably, the water spray covers the body from the chin 61 to the ankles 63, effecting virtually complete body coverage. The member 38, however, may be any length, for example, from the chest to knees, or from the waist to the neck.

Figure 5:
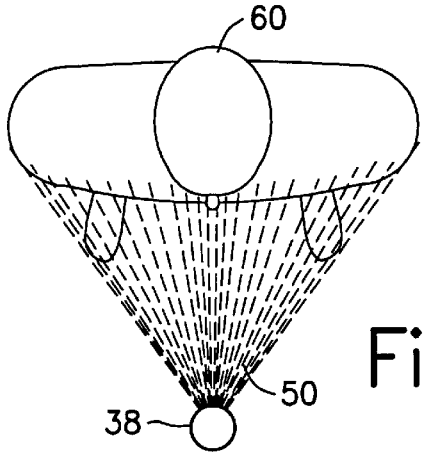
FIG. 5 is a side view of a water spray according to the present invention against a human.

Now referring to FIG. 5, there is shown a top view of the water spray in FIG. 4. The member 38 creates a triangular water spray 50. Preferably, the spray 50 covers a person 60 from shoulder to shoulder so that one entire side of a person from shoulder to shoulder is sprayed with direct water pressure at a substantially right angle.

It should be noted that in order to create a water spray of sufficient force to attain the objectives of the invention, a certain amount of water pressure is required from the pipe 10 of FIG. 1. This pressure is dependent on the number of holes and the diameter of the holes in the member. With more water pressure, there can be more holes or larger holes than with less water pressure. Where there is insufficient water pressure, a shorter member may be used as well, decreasing the number of holes used.

Figure 6:
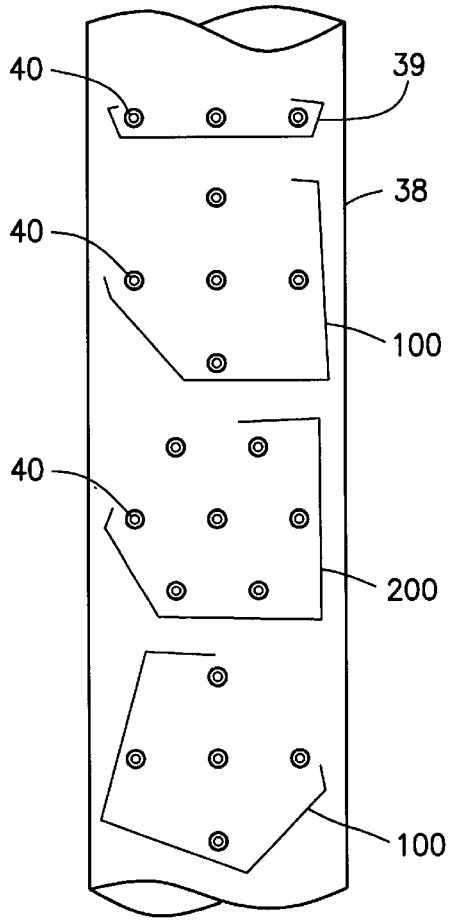
FIG. 6 is a top view of the water spray in FIG. 5.

FIG. 6 shows a preferred pattern of holes 40 on the member 38. A substantially horizontal row of holes (line 39) is provided at the top of the member that may be used to massage the gums and pick the teeth of a person. The remaining pattern of holes includes two repeating sub-patterns. The first sub-pattern is a five hole cross (line 100) and the second sub-pattern (line 200) includes seven holes. The first pattern is repeated after the second, and then the first, and so on. The holes are positioned on the member 38 to create the triangular pattern water spray, as previously discussed.

The virtually complete coverage of the spray pattern according to the present invention is especially advantageous for those with limited mobility such that they cannot position themselves to obtain direct water pressure on specific parts of their body. For example, it is difficult for a pregnant woman late in her pregnancy to turn, twist and bend over to achieve a direct water spray onto her lower back from a single overhead shower nozzle.

In a second embodiment according to the present invention, a number of members are positioned along the perimeter of a shower, pointing toward the center, to spray an object from different angles. The members may also act as handles to steady and maintain balance while entering and exiting the shower.

What is claimed is:

1. An improved shower apparatus comprising:

a substantially cylindrical member having an upper end and a lower end, the cylindrical member having a plurality of apertures disposed thereon in a predetermined pattern, the predetermined pattern constructed and arranged to create a horizontally triangular water spray;

means for removably attaching the upper end to a water source;

means for removably attaching the lower end to a stationary structure;

wherein the upper end is operably connected to a water source;

the lower end is closed;

the means for removably attaching the upper end to a water source further comprises a rubber hose having a top end and a bottom end, the top end adapted to be operably connected to the water source and the bottom end operably connected to the upper end of the substantially cylindrical member and the apparatus further comprises a retainer housing with the rubber hose is run through the retainer housing, looped around the retainer housing, and run through the retainer housing a second time.

2. The apparatus of claim 1 wherein the retainer housing further comprises means for adjusting the height of the substantially cylindrical member.

3. The apparatus of claim 2 wherein the means for adjusting the height of the substantially cylindrical member further comprises a knob for constricting and expanding the loop.

4. An improved shower apparatus for installation over a pre-existing shower comprising:

a selector valve having an input, a first output and a second output, the input having means for connecting the input to a water source, the first output having means for connecting the first output to a shower head;

a substantially cylindrical member having an upper end and a lower end, the cylindrical member having a plurality of apertures disposed thereon in a predetermined pattern, the predetermined pattern constructed and arranged to create a horizontally triangular water spray;

means for removably attaching the lower end to a stationary structure;

wherein the upper end is operably connected to the second output;

the lower end is closed; and, the means for removably attaching the upper end to a water source further comprises a rubber hose having a top end and a bottom end with the top end operably connected to the water source and the bottom end operably connected to the upper end of the substantially cylindrical member, the apparatus further comprises a retainer housing wherein the rubber hose is run through the retainer housing, looped around the retainer housing, and run through the retainer housing a second time.

5. The apparatus of claim 4 wherein the retainer housing further comprises means for adjusting the height of the substantially cylindrical member.

6. The apparatus of claim 5 wherein the means for adjusting the height of the substantially cylindrical member further comprises a knob for constricting and expanding the loop.

7. An improved shower apparatus for installation over a pre-existing shower comprising:

a selector valve having an input, a first output and a second output, the input having means for connecting the input to a water source, the first output having means for connecting the first output to a shower head;

a flexible loop hose having an input end and an output end;

a retainer housing for retaining the loop hose, the retainer housing having a knob for constricting and expanding the loop;

a substantially cylindrical member having an upper end and a lower end, the cylindrical member having a plurality of apertures disposed thereon in a predetermined pattern, the predetermined pattern constructed and arranged to create a horizontally triangular water spray;

means for removably attaching the lower end to a stationary structure;

wherein the second output of the selector valve is operably connected to the input end of the loop hose, and the output end of the loop hose is operably connected to the upper end of the member.

8. The apparatus of claim 7 wherein the means for removably attaching the lower end to a stationary structure further comprises a clip and a suction cup.

* * * * *